US006826867B1

(12) United States Patent
McDonald et al.

(10) Patent No.: US 6,826,867 B1
(45) Date of Patent: Dec. 7, 2004

(54) SLIDING DOOR ASSEMBLY

(76) Inventors: Timothy J. McDonald, 108 Bayou Dr., Niceville, FL (US) 32578; Allen Helmuth, 219 Benning Dr., Destin, FL (US) 32541; Giorgio Giuriato, 210 Annabelle Dr., Mary Esther, FL (US) 32569

( * ) Notice: Subject to any disclaimer, the term of this patent is extended or adjusted under 35 U.S.C. 154(b) by 22 days.

(21) Appl. No.: 10/369,264

(22) Filed: Feb. 18, 2003

(51) Int. Cl.[7] ..... E05D 15/10
(52) U.S. Cl. ..... 49/213; 49/209; 49/449
(58) Field of Search ..... 292/241, DIG. 46, 292/97, 199, 196; 49/209, 213, 214, 221, 225, 210, 211, 276, 278, 409, 410, 425, 449

(56) References Cited

U.S. PATENT DOCUMENTS

| | | | | | |
|---|---|---|---|---|---|
| 344,746 | A | * | 6/1886 | Moore | 49/214 |
| 890,626 | A | * | 6/1908 | Edwards | 49/209 |
| 1,109,071 | A | * | 9/1914 | Judia | 49/276 |
| 1,515,558 | A | * | 11/1924 | Ebling | 49/214 |
| 1,701,932 | A | * | 2/1929 | Nelson | 292/41 |
| 2,028,617 | A | * | 1/1936 | Lute | 49/235 |
| 2,140,890 | A | * | 12/1938 | Waitekaites | 49/158 |
| 2,784,445 | A | * | 3/1957 | Greig et al. | 16/105 |
| 2,878,532 | A | * | 3/1959 | Clark | 49/139 |
| 3,040,392 | A | * | 6/1962 | Beauchamp | 49/276 |
| 3,119,480 | A | * | 1/1964 | Fuchs | 192/44 |
| 3,225,393 | A | * | 12/1965 | Harold | 49/213 |
| 3,386,204 | A | * | 6/1968 | Obata | 49/212 |
| 3,640,565 | A | * | 2/1972 | Anderson | 296/100.04 |
| 3,660,936 | A | * | 5/1972 | Bryson | 49/209 |
| 4,064,810 | A | | 12/1977 | Jenkins et al. | |
| 4,317,312 | A | | 3/1982 | Heideman | |
| 4,341,043 | A | * | 7/1982 | Yamamoto et al. | 49/449 |
| 4,384,429 | A | | 5/1983 | Rokicki et al. | |
| 4,438,595 | A | | 3/1984 | MacDonald | |
| 4,590,707 | A | | 5/1986 | von Resch | |
| 4,662,110 | A | | 5/1987 | Rokicki | |
| 4,669,219 | A | | 6/1987 | Tomida | |
| 4,691,474 | A | | 9/1987 | Rokicki | |
| 4,726,145 | A | | 2/1988 | Rokicki | |
| 5,513,469 | A | | 5/1996 | Tajudeen et al. | |
| 5,647,172 | A | | 7/1997 | Rokicki | |
| 5,736,671 | A | | 4/1998 | Perala et al. | |
| 5,884,361 | A | | 3/1999 | Richardson et al. | |
| 6,041,551 | A | | 3/2000 | Aspenwall | |
| 6,052,867 | A | | 4/2000 | Haab et al. | |
| 6,170,207 | B1 | * | 1/2001 | Saindon | 52/204.2 |
| 6,176,041 | B1 | | 1/2001 | Roberts | |
| 6,216,392 | B1 | * | 4/2001 | DiGinosa | 49/183 |
| 6,264,252 | B1 | * | 7/2001 | Clancy | 292/196 |
| 6,330,769 | B1 | | 12/2001 | Manzella et al. | |
| 6,497,072 | B2 | * | 12/2002 | Fries | 49/209 |
| 6,637,784 | B1 | * | 10/2003 | Hauber et al. | 292/300 |

* cited by examiner

*Primary Examiner*—Gregory J. Strimbu
(74) *Attorney, Agent, or Firm*—Peter Loffler

(57) ABSTRACT

A sliding door has a sash suspended from a top leg of a frame by having a curved channel extend along this leg and providing the sash with a post that passes through the channel and a roller attached to the post, such that the roller sits on the leg and permits the sash to slide relative to the frame. In closing the door, the sash moves towards the inner portion of the frame and is pressed against a compression gasket that extends about the inner portion of the door in order provide an airtight seal between the sash and the frame. A handle is operatively connected to a dog that is attached to the frame which dog acts on an inner wall of a jamb on the frame in order to maintain the seal.

23 Claims, 7 Drawing Sheets

SLIDING DOOR ASSEMBLY

BACKGROUND OF THE INVENTION

1. Field of the Invention

The present invention relates to a sliding door assembly wherein the sash of the door seals against the door frame.

2. Background of the Prior Art

The main function of a building's envelope is to prevent water penetration into the interior of a building where such water can cause substantial damage. One problem in any envelope design is the junction between two or more items made from dissimilar materials such as where doors and windows integrate with the main building facade. As the two items are made from different materials, each material thermally expands and contracts at a different rate placing stress on the boundary joint of the two items. Caulks having a high coefficient of expansion and other techniques are used to address this problem. The caulks expand and contract and help modulate the expansion and contraction of the materials to which they are deposited upon.

Operable windows are another problem area in building moisture intrusion. By definition, when a window is open, access is provided into the interior of the building. Therefore, once the window is closed it must provide a moisture barrier for the building. Windows that swing out to open, similar to doors, press up against a peripheral flange on the window frame, which flange has a gasket thereon, which seals the sash of the window against the frame providing the moisture barrier. In the case of an in-swing door, wherein the bottom of the door does not press up against a sealing flange, appropriate rubber sweeps are placed along the bottom of the door in order to block moisture penetration therepast and the threshold is angled outwardly in order to channel any residual moisture back out.

Sliding windows present another problem in dealing with moisture penetration. As the window must slide up and down in a track, the window cannot press against a sealing flange like a swing window. As the window only presses up against one side of its sash, this is the only side where it is possible to have a press seal against the frame. The opposing side, where the sash typically interacts with another sash, which other sash may be fixed or movable, a gasket is provided on one of the sashes in order to provide a barrier between this junction. While such a gasket is not as formidable as a press seal, this junction is constructed such that the upper sash is oriented outwardly relative to the lower sash so that any moisture that challenges this gasket seal must travel upwardly to get to this seal. While it is possible to have storms that have winds that drive rain upwardly, the vertical vector component of such winds are not very large, therefore, the rain acts on the gasket with only a relatively small force, which the gasket handles. Additionally, such storms are very infrequent so that the gasket is not subject to frequent substantial challenges.

The sides of the window wherein the sash rides in a track pose a different problem. As the sash must travel up and down along this track, an airtight seal between sash and frame along the track is not possible. However, the tolerances between the sash and the frame are very tight so that most if not all moisture is stopped at the junction of sash and frame. For any moisture that bypasses this junction, the frames typically have a flanging system that deflects the water and channels the water back to the outside.

The problems associated with moisture barrier protection for horizontal sliding windows and more particularly sliding glass doors is much more challenging. The junction between two closed sashes on a sliding glass door is vertical. Therefore, the gasket that seals the junction between the two sashes is subject to rain any time the wind blows from the appropriate direction during a storm and as the door is at ground level, the lower part of the junction is subject to a rain load almost every shower due to the rain hitting the ground proximate the sash and splashing against the seal. Additionally, the flanging systems used on the windows to deflect moisture that passes the sash-frame contact area cannot be effectively used on the lower part of the door. As people must be able to pass through the door, the lower threshold must be kept to a reasonably short height in order to adequately facilitate walking therethrough. This height restriction is set not only by the desired comfort level of users of the door, but also by the Americans with Disabilities Act which sets upper height restrictions on all new construction sliding doors. Therefore, vertically disposed flanging systems that are commonly found on hung windows, which systems tend to be relatively wide, cannot be effectively deployed on a sliding glass door that has threshold height restrictions and which also requires that the threshold be subject to the forces associated with people walking thereon. Accordingly, moisture barrier systems found on sliding doors tend to be less reliable relative to other door and window moisture barrier systems.

The flanging systems found on current sliding doors tend to have multiple spaced apart flanges in order to accommodate the tracks upon which each sash of the door slides and to act as rain barriers. Such a multiple flange configuration, even though it is relatively low in height, is somewhat uncomfortable to walk across and is difficult to bypass in a wheelchair that must pass across the several flanges.

Additionally, sliding doors tend to be larger than most windows, therefore, they tend to become "loose" over time through repeated use. As such doors require tight interfitting between parts in order to provide a strong moisture barrier, such loosening tends to degrade the moisture barrier capabilities of the door.

Therefore, there exists a need in the art for a sliding door system that has moisture barrier capabilities that overcome the above stated problems found in the art. Specifically, such a door must provide a high level of reliability in its moisture barrier properties while maintaining a sufficiently small lower threshold that addresses user comfort and complies with the Americans with Disabilities Act. Such a door must maintain the high level of moisture barrier reliability even if the door becomes loose through normal wear and tear and the passage of time. The threshold found on such a door should be relatively more comfortable to walk across with respect to current sliding door systems and must be relatively easy to bypass in a wheelchair. Ideally, such a door will be of relatively simple design and construction using standard manufacturing techniques to construct and will be relatively easy to use and maintain.

SUMMARY OF THE INVENTION

The sliding door assembly of the present invention addresses the aforementioned needs in the art. The sliding door assembly provides a a moisture barrier that has a high level of reliability. The sliding door assembly uses a small lower threshold that addresses user comfort and complies with the Americans with Disabilities Act. The flanging system on the threshold is relatively more comfortable to walk across with respect to current sliding door systems and is relatively easy to bypass in a wheelchair. The sliding door assembly maintains the high level of moisture barrier reliability even after the door becomes loose through normal wear and tear and the passage of time. The sliding door assembly is of relatively simple design and construction using standard manufacturing techniques and is relatively easy to use and maintain.

The sliding door assembly of the present invention is comprised of a frame that has a top leg and a bottom leg joined by a first side leg and a second side leg such that a first channel is located along a portion of the top leg, the first channel having a curved portion. A pocket extends along a portion of the top leg, the first side, a portion of the bottom leg, and between the top leg and the bottom leg, along a mullion. A compression gasket is located within the pocket, the gasket being continuous in order to form a closed loop. A first jamb extends along the first side leg, the first jamb having a first angled face, a first opening located on the first angled face, and a first inner wall. A first sash has a second jamb with a second angled face located along a first side edge of the first sash. The first sash also has an inner face and an outer face. A post, having a roller, is attached to a top edge of the first sash and passes through the first channel such that the roller rests on the top leg in order to gravitationally suspend the first sash therefrom and permit the first sash to slide along the top leg. A first dog is rotatably attached to the first side edge of the first sash. A third jamb extends along the mullion, the third jamb having a third angled face, a second opening located on the third angled face, and a second inner wall. The first sash has a fourth jamb with a fourth angled face located along a second side edge of the first sash opposite the first side edge. A second dog is also rotatably attached to the second side edge of the first sash. A handle is attached to the first sash and is operatively connected to the first dog and the second for rotation of the two dogs. A second sash is fixedly attached to the frame and to the mullion. The first sash is slidable between an open position and a closed position wherein when the first sash is in a closed position, the first angled face faces the second angled face in close proximity and the third angled face faces the fourth angled-face in close proximity. The handle is activated in order to rotate the first dog and the second dog so that the first dog passes through the first opening and acts on the first inner wall and the second dog passes through the second opening and acts on the second inner wall so that the inner face of the first sash presses against the gasket in order to achieve an airtight seal between the first sash and the gasket. The bottom leg has a second channel and the first sash has a pin that passes through the second channel, the pin helping to stabilize the first sash during first sash movement. The handle can be latched, which may be an over-center latch, in order to maintain the dogs in the acting relationship with their respective inner walls. Ramped detents located on the top leg help hold the first sash in a fully closed or a fully open position.

BRIEF DESCRIPTION OF THE DRAWINGS

Similar reference numerals refer to similar parts throughout the several views of the drawings.

DESCRIPTION OF THE PREFERRED EMBODIMENT

Figure 1:
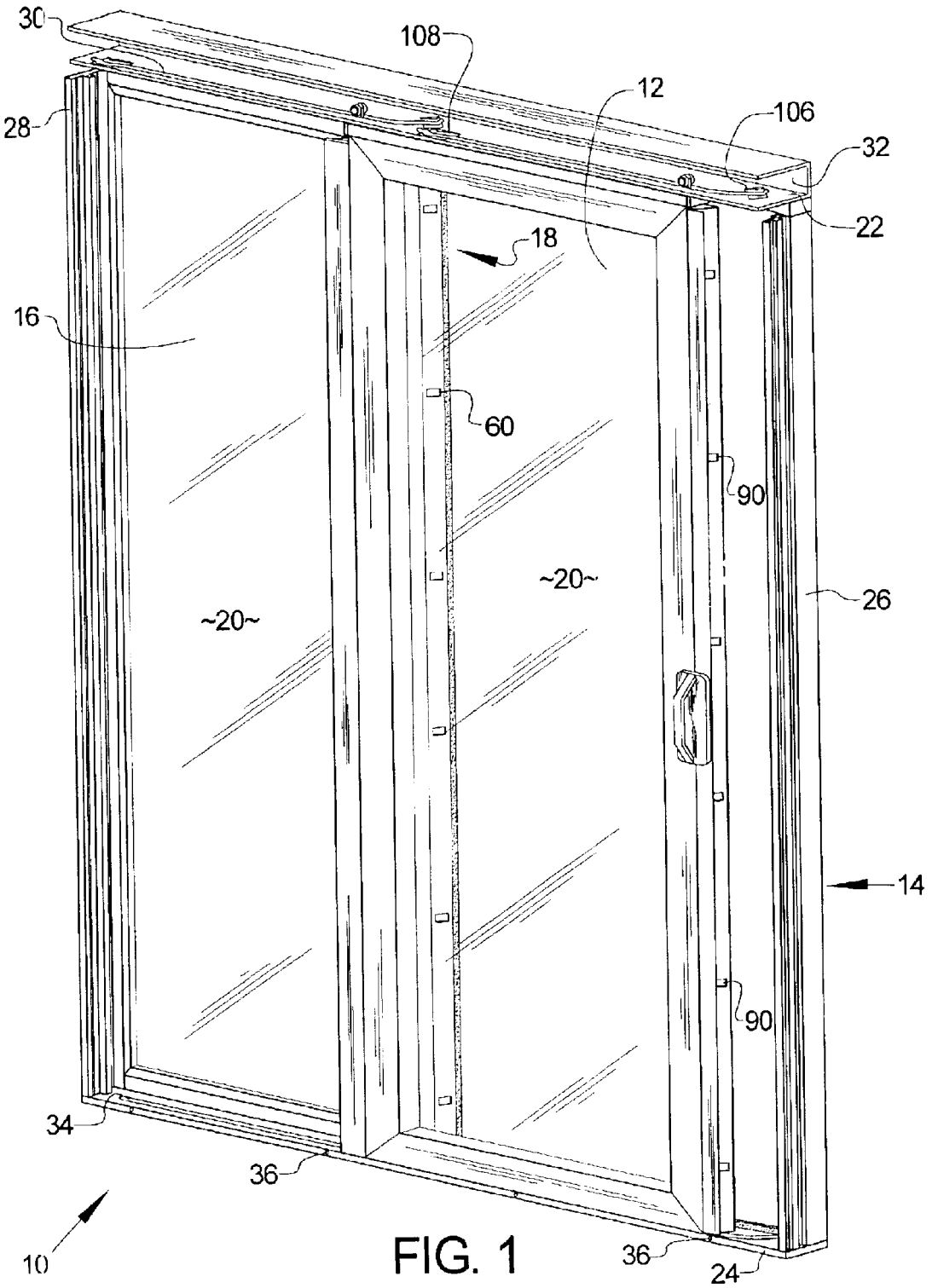
FIG. 1 is a perspective view of the sliding door assembly of the present invention in an open position.
Figure 2:
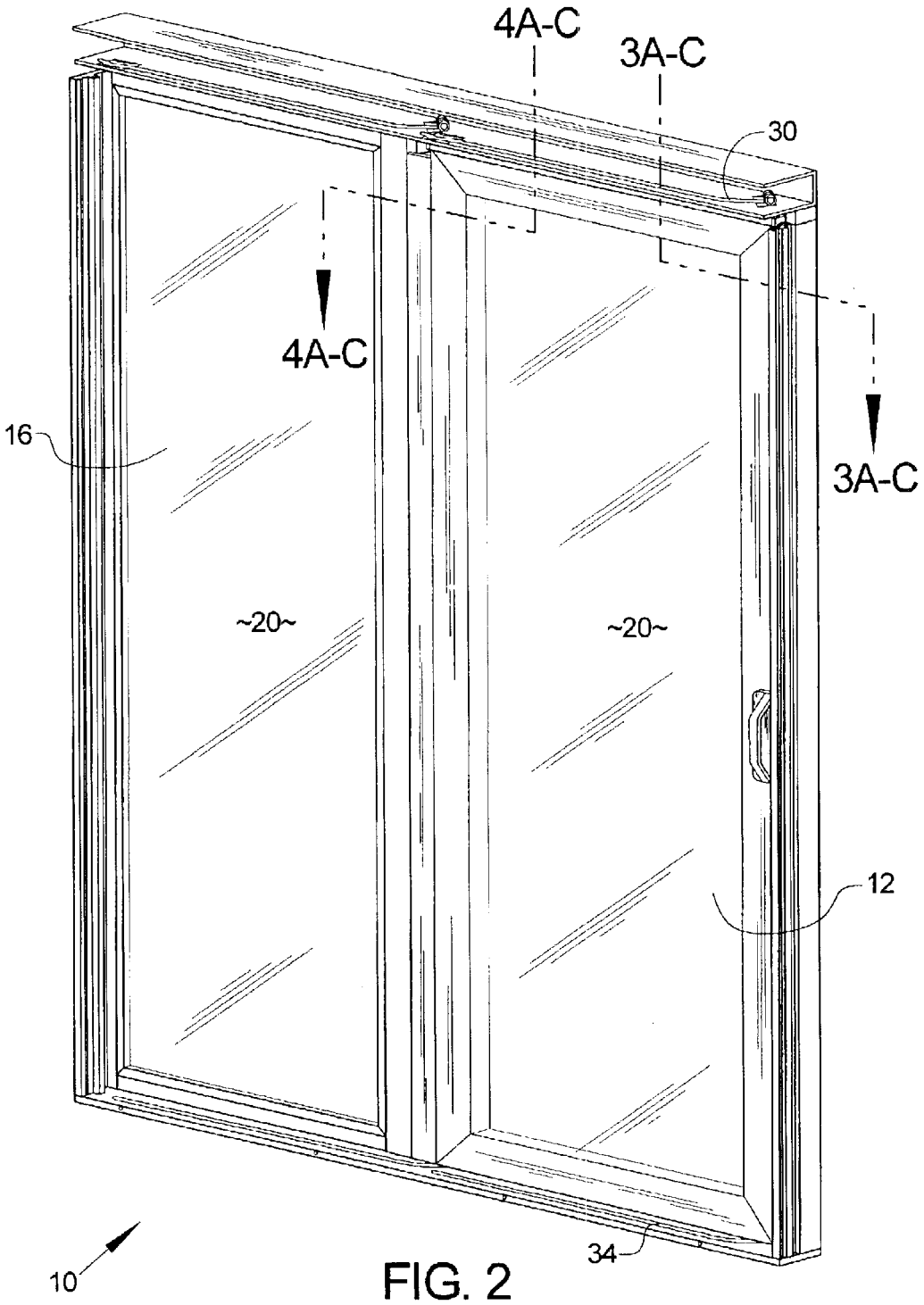
FIG. 2 is a perspective view of the sliding door assembly of the present invention in a closed position.
Figure 3A:
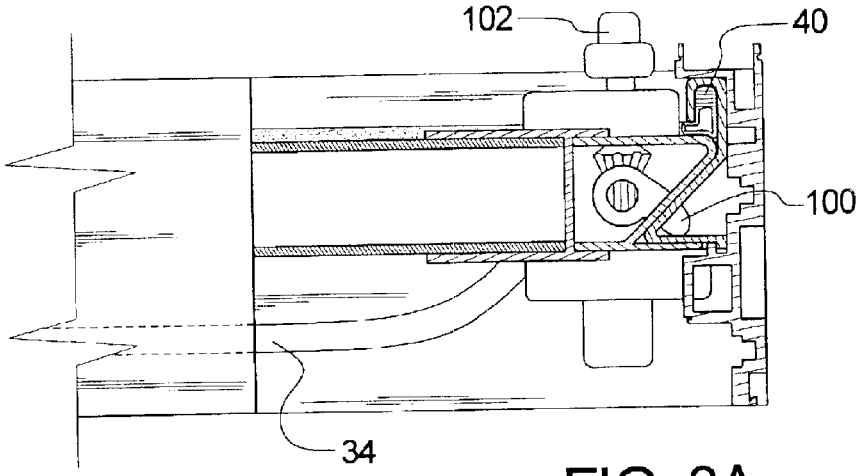
FIG. 3A is a sectioned view, taken along line 3A–C in FIG. 2, showing the door in a closed and locked position.
Figure 3B:
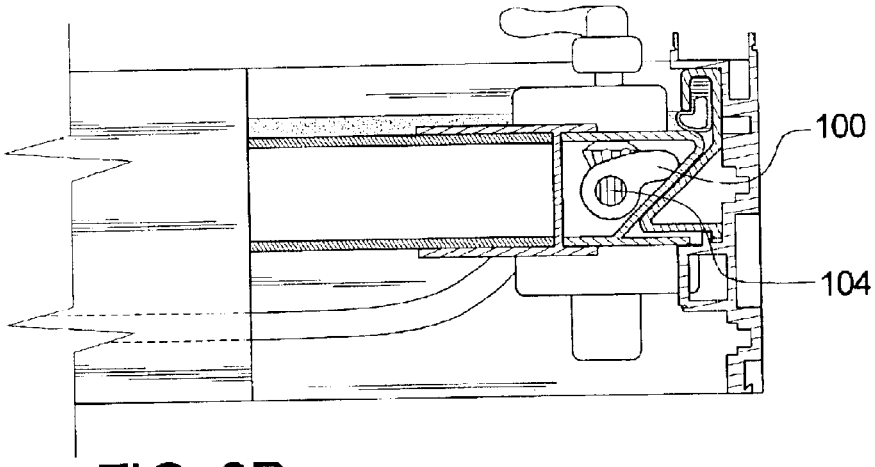
FIG. 3B is a sectioned view, taken along line 3A–C in FIG. 2, showing the door in a closed and unlocked position.
Figure 3C:
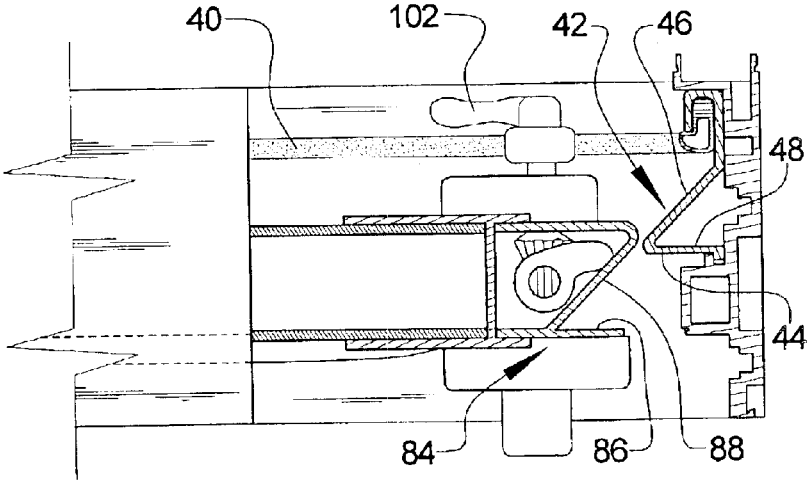
FIG. 3C is a sectioned view, taken along line 3A–C in FIG. 2, showing the door in an open position.
Figure 4A:
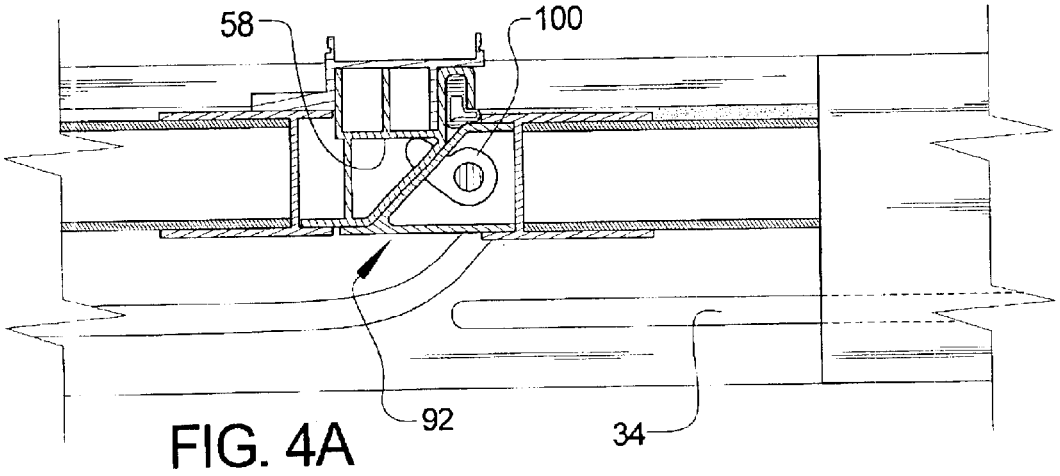
FIG. 4A is a sectioned view, taken along line 4A–C in FIG. 2, showing the door in a closed and locked position.
Figure 4B:
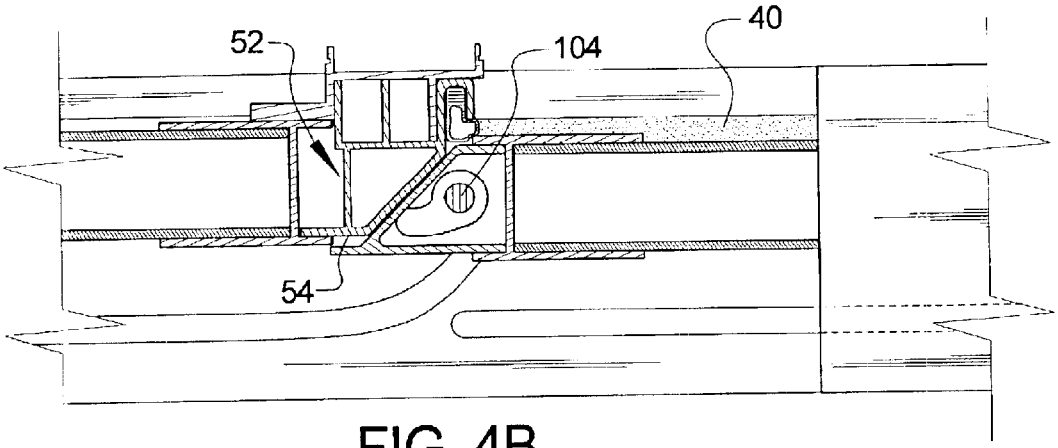
FIG. 4B is a sectioned view, taken along line 4A–C in FIG. 2, showing the door in a closed and unlocked position.
Figure 4C:
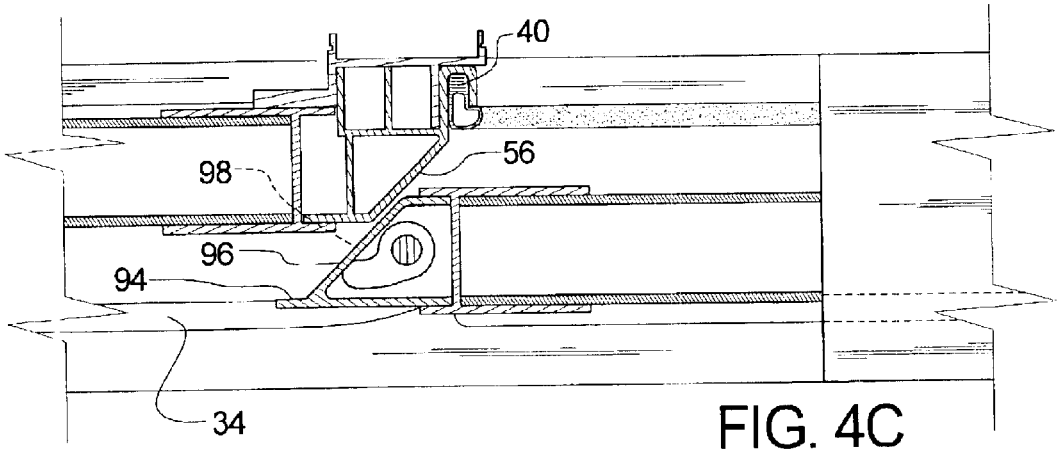
FIG. 4C is a sectioned view, taken along line 4A–C in FIG. 2, showing the door in an open position.
Figure 5:
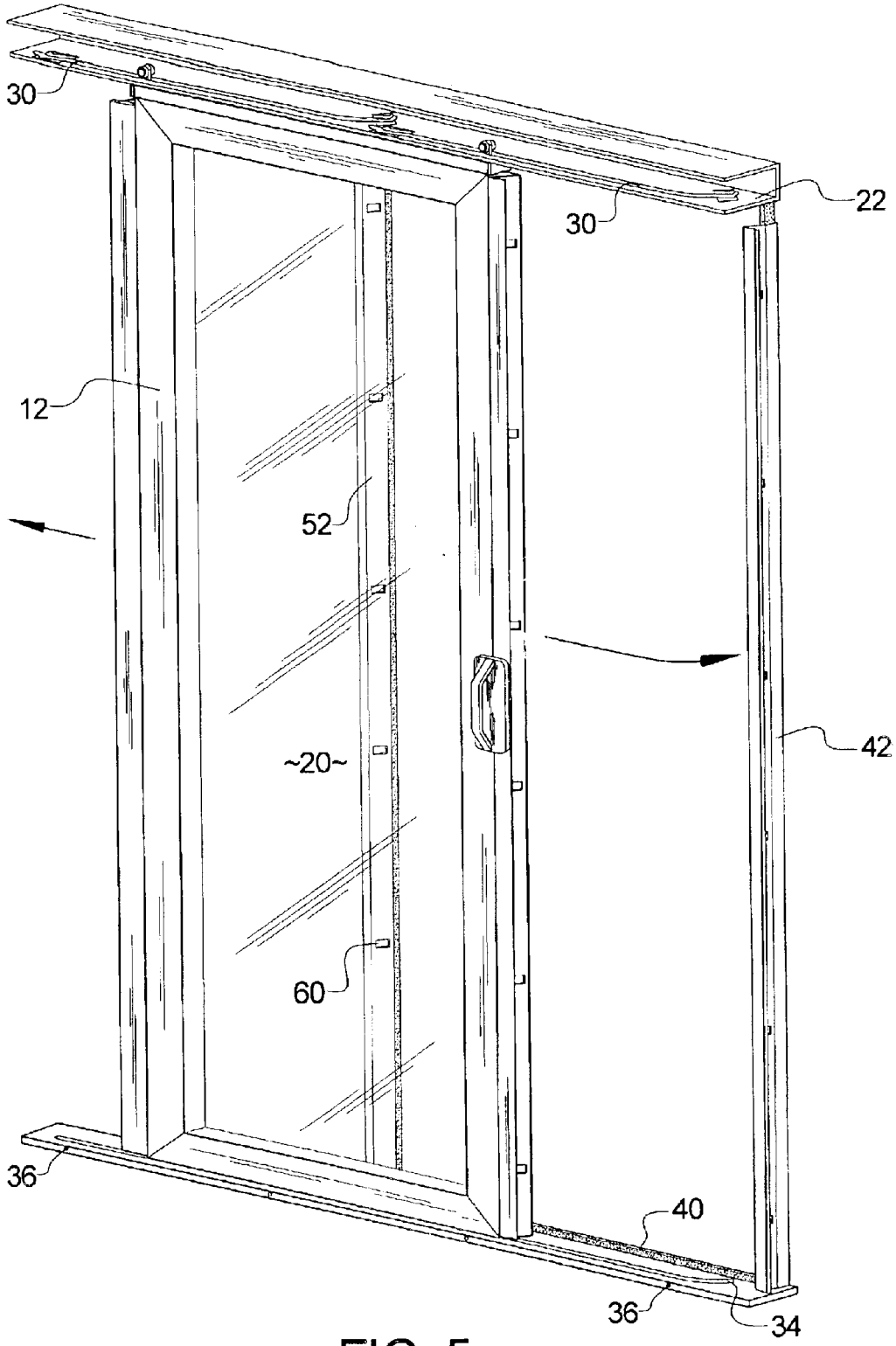
FIG. 5 is a perspective view of the operable sash illustrating the range of motion of the sash.
Figure 6:
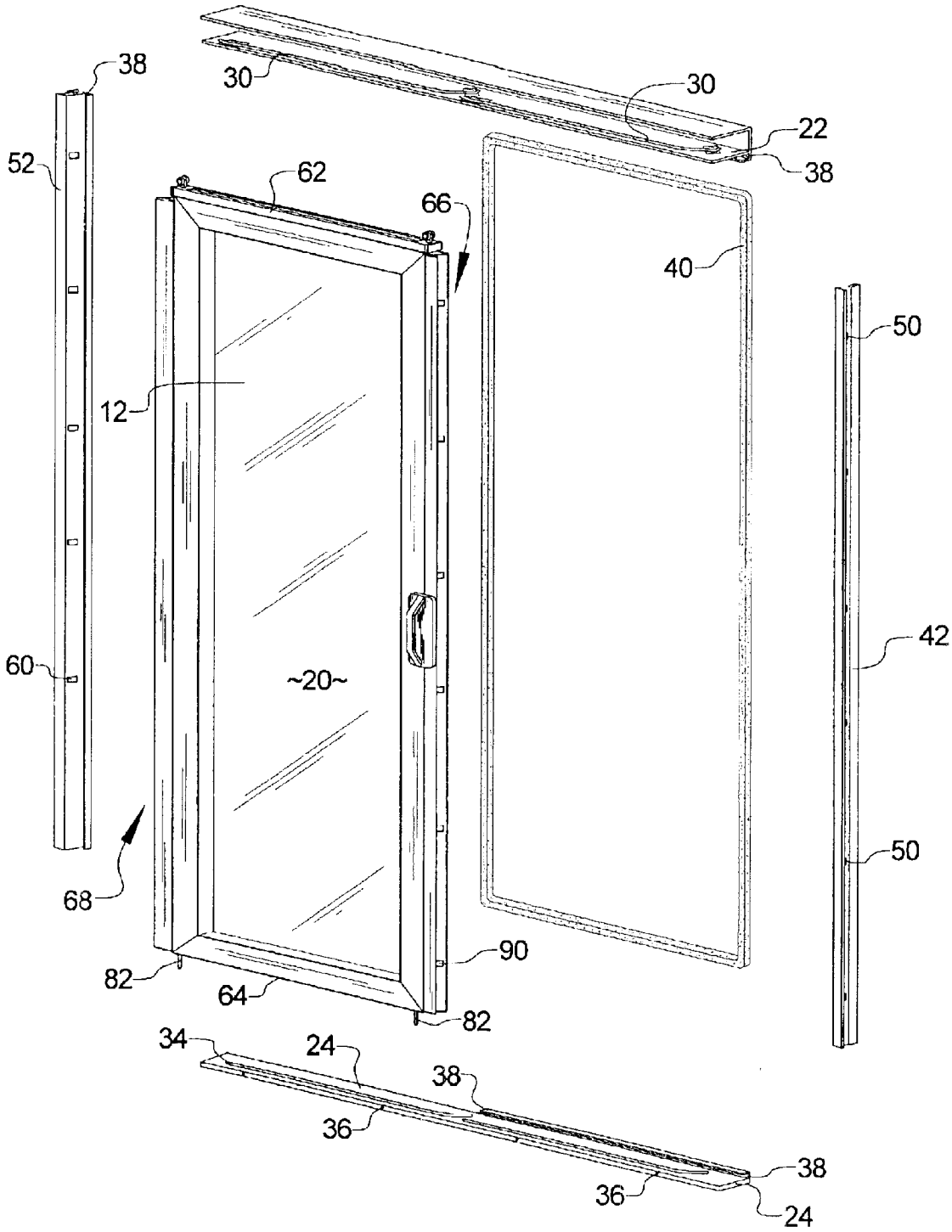
FIG. 6 is an exploded view of the sliding door assembly.
Figure 7:
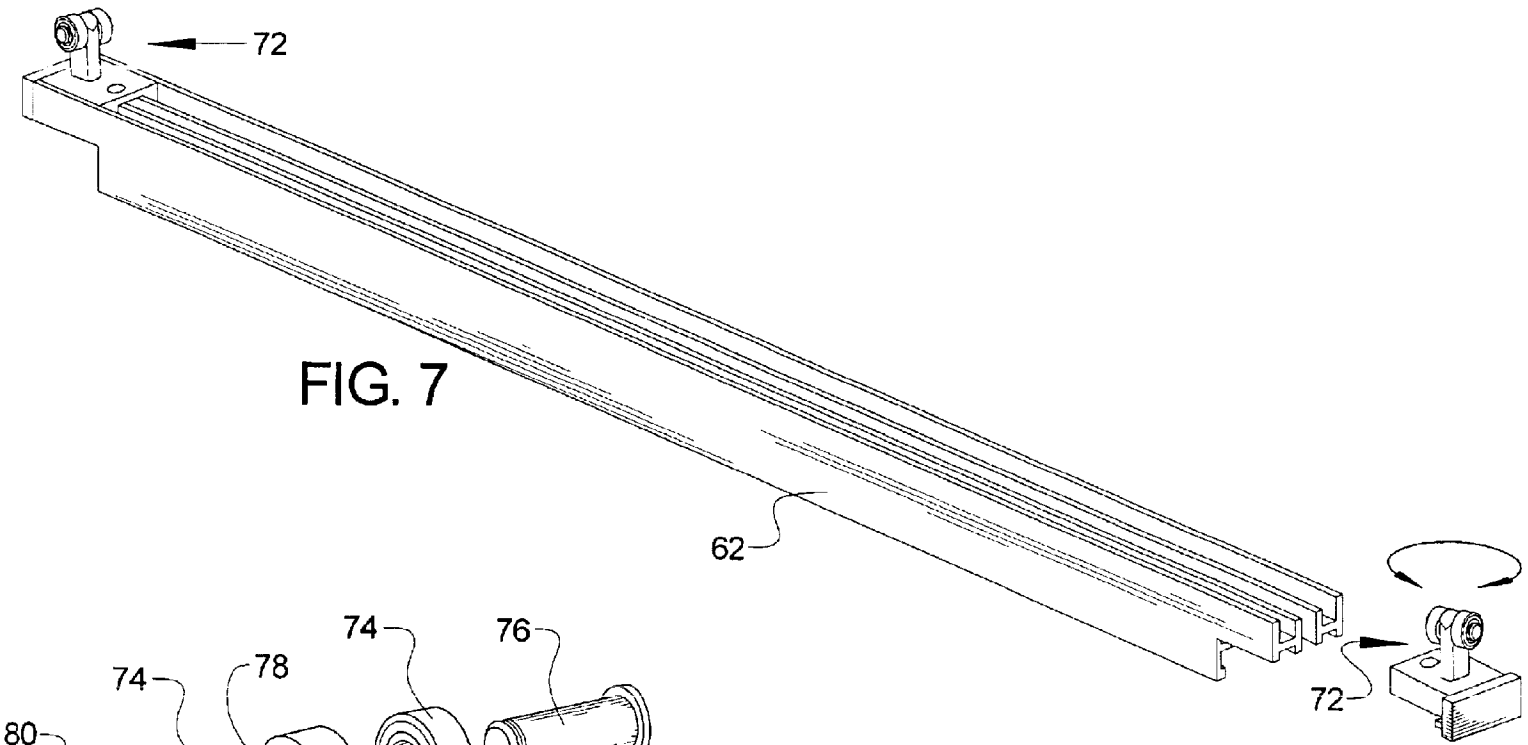
FIG. 7 is a close-up view of the top side edge of the sash.

Referring now to the drawings, it is seen that the sliding door assembly of the present invention, generally denoted by reference numeral 10, is comprised of a first sash 12 that slides within a frame 14 and a second sash 16 that is fixed to the frame 14 and to a mullion 18 described below. Each sash 12 and 16 may have appropriate glazing 20 therein as desired.

As seen, the frame 14, which may be generally rectangular has a top leg 22, a bottom leg 24, a first side 26 joining the top leg 22 and the bottom leg 24 and a second side 28 also joining the top leg 22 and the bottom leg 24. The mullion 18 extends between the top leg 22 and the bottom leg 24, which mullion 18 is generally parallel with the two side legs 26 and 28 and positioned between the side legs 26 and 28. The top leg 22 has at least one channel 30 located thereon below the nailing fin 32. Each channel 30 has a straight portion and a curved portion. The bottom leg 24 also has at least one channel 34 that also has a straight portion and a curved portion. Advantageously, although strictly not necessarily, each bottom channel 34 is coextensive with a respective one of the top channel 30 and vice versa. At least one weep hole 36 is located below on the bottom leg 24 so that any moisture that enters the second channel 34 is expelled through the weep hole 36.

A pocket 38 is located on the first side leg 26, the portion of the top leg 22 that extends between the first side leg 26 and the mullion 18, on the mullion 18, and on the bottom leg 24 between the first leg 22 and the mullion 18 so that the pocket 38 is continuous. A compression gasket 40 is located within the pocket 38 and is also continuous and may be of single piece construction. A first jam 42 is located on the first side leg 26 such that the first jamb 42 has a first seating face 44, a first angled face 46, that is angled relative to the first seating face 44, and a first inner wall 48 beyond the first angled face 46. At least one first opening 50 is located on the first angled face 46 of the first jamb 42. A second jamb 52 is located on the mullion 18, the second jamb 52 having a second seating face 54, a second angled face 56, that is angled relative to the second seating face 54, and a second inner wall 58 beyond the second angled face 56. At least one second opening 60 is located on the second jamb 52 in order to allow access to the second inner wall 58.

Figure 8:
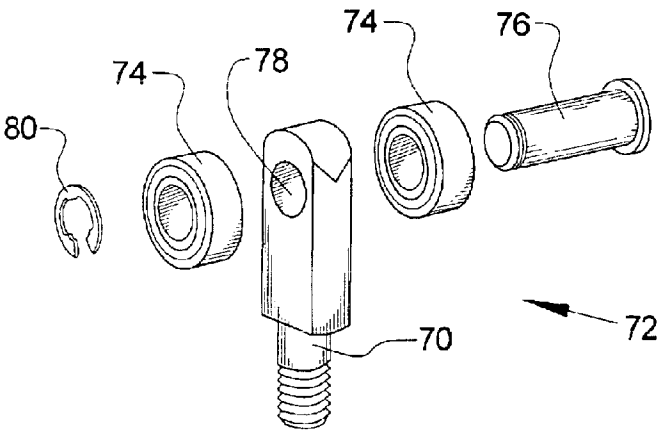
FIG. 8 is an exploded view of the roller assembly.

The first sash 12 has a top edge 62 and a bottom edge 64 joined by a first side edge 66 and a second side edge 68. A post 70 is located on the top edge 62 of the first sash 12 and has a roller assembly 72 on the top thereof. As seen in FIG. 8, the roller assembly 72 is comprised of one or more rollers 74 that have an axial pin 76 that passes through an opening 78 located on the post 70, the axial pin 76 having an appropriate clip 80 to retain the axial pin 76 within the opening 78. The post 70 passes through the first channel 30 such that the rollers 74 sit on the top surface of the top leg 22 and roll thereon. This gravitationally suspends the first sash 12 from the frame 14. The post 70 is able to rotate with respect to the first sash 12 in order to allow the roller assembly to turn with a corresponding change of direction of the first sash 12 when the post 70 enters the curved portion of the first channel 30 so that the post 70 and its roller assembly 72 can follow the curvature of the first channel 30. The roller assembly can be clipped onto the top edge 62 of the first sash 12. The first sash 12 can have more than one post 70 and roller assembly 72, such as illustrated in FIGS. 1, 2, 5 and 6, wherein the first sash 12 has a post 70 and roller assembly 72 proximate each corner of the first sash 12 with each post 70 passing through a respective first channel 30 of the top leg 22 of the frame 14. If first sash 12 is particularly large or heavy, the first sash can have three or more posts 70 and roller assemblies 72 each cooperating with a respective first channel 30 on the top leg 22 of the frame 14. Alternately, the roller assembly 72 can comprise multiple rollers 74 or roller pairs disposed serially along the post 70 (similar to the landing gear carriage of a jumbo jet) which roller assembly 72 can be attached to the first sash 12 by one or more posts 70.

At least one pin 82 is attached to the bottom edge 64 of the first sash 12 such that the pin 82 passes through the second channel 34 located on the bottom leg 24 of the frame 14. Advantageously, although not necessarily, each pin 82 is disposed generally directly below each post 70 located on the top edge 62 of the first sash 12. The pin 82 rides in the second channel 34 during first sash 12 movement and, by having a diameter that is only slightly smaller than the width of the second channel 34, helps maintain the stability of the first sash 12 during first sash 12 movement.

A third jamb 84 is located on the first side edge 66 of the first sash 12, which third jamb 84 has a third seating face 86, a third angled face 88, and at least one third opening 90, while a fourth jamb 92 is located on the second side edge 68 of the first sash 12, which fourth jamb 92 has a fourth seating face 94,a fourth angled face 96, and at least one fourth opening 98.

Accordingly, the first sash 12 is able to slide within at least a portion of the frame 14 with the post 70 and roller assembly 72 suspending the first sash 12 from the top leg 22 of the frame 14 such that the roller assembly 72 facilitates the sliding of the first sash 12. This permits the first sash 12 to slide between an open position (FIGS. 1, 3C, 4C, and 5) and a closed positioned (FIGS. 2, 3A, 3B, 4A, and 4B) with respect to the frame 14.

In order to slide the first sash 12 from the open position to the closed position, the first sash 12 is moved appropriately. As the first sash 12 nears closing, the post 70 enters the curved portion of the first channel 30 of the top leg 22 of the frame 14 (and correspondingly, the pin 82 enters the curved portion of the second channel of the bottom leg 24 of the frame 14) causing the first sash 12 to change direction from is lateral movement with respect to the frame 14 and move toward the gasket 40 in following the curvature of the first channel 30 of the top leg 22. When the first sash 12 is fully closed, the third jamb 84 seats on the first jamb 42 such that the third seating face 86 of the third jamb 84 is seated on the first seating face 44 of the first jamb 42 and the first angled face 46 of the first jamb 42 seats on the third angled face 88 of the third jamb 84. Correspondingly, the second jamb 52 seats on the fourth jamb 92 such that the second seating face 54 of the second jamb 52 is seated on the fourth seating face 94 of the fourth jamb 92 and the second angled face 56 of the second jamb 52 seats on the fourth angled face 96 of the fourth jamb 92. The inner face of the first sash 12 presses against the gasket 40 in order to create a seal.

In order to press the first sash 12 against the gasket 40 on the frame 14 a compression subsystem is used. The compression subsystem is comprised of at least one dog gear 100 that is rotatably attached to the first side edge 66 of the first sash 12 and to the second side edge 68 of the first sash 12. A handle 102 is attached to the first sash 12 and is operatively connected to the dog gears 100. More than one dog gear 100 may be located along the first side edge 66 of the first sash 12 and along the second side edge 68 of the first sash 12. The handle 102 may be connected by a gear system (not illustrated) of any standard design that directly connects to each dog gear 100 or some or all of the dog gears 100 may be attached to a shaft 104 such that operation of the handle 102 causes the gear system to rotate the shaft 104 which in turn rotates the dog gears 100. The handle 102 may have an appropriate lock subsystem, such as a bi-directional clutch or an over-center latch, in order to maintain the handle 102 in a given position. Specifically, when the first sash 12 is in the closed position, the handle 102 is rotated so as to rotate the dog gears 100 such each dog gear 100 in the right side edge 66 of the first sash 12 pass through a respective first opening 50 of the first jamb 42 and through a respective third opening 90 of the third jamb 84 and presses upon the first inner wall 48 of the first jamb 42, while simultaneously, each dog gear 100 on the second side edge 68 of the first sash 12 passes through a respective second opening 60 of the second jamb 52 and through a respective fourth opening 98 of the fourth jamb 92 and presses upon the second inner wall 58 of the second jamb 52. This causes the first sash 12 to be pressed onto the gasket 40 on the frame 14 thereby creating a seal. This also prevents the first sash 12 from moving, thereby effectively locking the door system 10. The lock subsystem of the handle 102 maintains the dog gears 100 in this position. In order to move the first sash 12 into the open position, the handle 100 is counterrotated causing the dog gears 100 to rotate in reverse direction and thereby exiting their respective openings. This unlocks the first sash 12 and allows it to slide with respect to the frame 14.

A first detent 106 is located on the top leg 22 proximate the curved portion of the first channel 30 while a second detent 108 is located on the top leg 22 proximate the opposite side of the first channel 30 relative to the side with the first detent 106. When the first sash 12 is slid into the closed position, the roller 74 rolls into the first detent 106 with this detent 106 helping to hold the sash 12 in the closed position without having to lock the sash 12 closed. The first detent 106 maintains the roller 74 within the detent 106 thereby helping prevent the sash 12 from sliding back into an opened position. The first detent 106 is ramped so that when a person is sliding the sash 12 into the closed position, the roller 74 gradually rolls into the first detent 106 avoiding the sash 12 from being slammed closed. Additionally, when the sash 12 is being slid open, the ramped nature of the first detent 106 helps the person opening the sash 12 to be able to gradually and easily roll the roller 74 out of the detent 106 and place the sash 12 into an open position. In similar fashion, when the first sash 12 is slid into a fully open position, the roller 74 rolls into the second detent 108 with this detent 108 helping to hold the sash 12 in the open position. The second detent 108 maintains the roller 74 within the detent 108 thereby helping prevent the sash 12 from sliding back into a partially open position. The second detent 108 is also ramped so that when a person is sliding the sash 12 into the fully open position, the roller 74 gradually rolls into the second detent 108 avoiding the sash 12 from being slammed open. Additionally, when the sash 12 is being slid back toward a closed position, the ramped nature of the second detent 108 helps the person performing this task to be able to gradually and easily roll the roller 74 out of the second detent 108.

While the invention has been particularly shown and described with reference to an embodiment thereof, it will be appreciated by those skilled in the art that various changes in form and detail may be made without departing from the spirit and scope of the invention.

We claim:

1. A sliding door comprising:

a frame having a top leg and a bottom leg joined by a first side leg and a second side leg;

a compression gasket extends along a portion of the top leg, the first side leg, a portion of the bottom leg, and between the top leg and the bottom leg;

a first jamb extending along the first side leg, the first jamb having a first angled face that is angled relative to the first side leg, an opening located in the first angled face, and an inner wall;

a sash, having a second jamb with a second angled face that is angled relative to the first side leg and is located along a side edge of the sash, the sash also having an inner face and an outer face, the sash being suspended on the top leg of the frame and capable of sliding on the top leg;

a dog rotatably attached to the side edge of the sash;

a handle attached to the sash and operatively connected to the dog for rotation of the dog; and wherein the sash is slidable between an open position and a closed position wherein when the sash is in the closed position, the first angled face faces the second angled face, and the handle is activated in order to rotate the dog in order for the dog to pass through the opening and act on the inner wall so that the inner face of the sash presses against the gasket in order to achieve a seal between the sash and the gasket.

2. The sliding door as in claim 1 wherein the gasket is located within a pocket that extends along the portion of the top leg, the first side leg, the portion of the bottom leg, and between the top leg and the bottom leg.

3. The sliding door as in claim 2 further comprising a mullion that extends between the top leg and the bottom leg such that the portion of the pocket that extends between the top leg and the bottom leg is located on the mullion.

4. The sliding door as in claim 1 wherein the top leg has a first channel, the first channel having a first end and a second end and extending along the portion of the top leg, and the sash has a post that passes through the first channel, the post having a roller that rolls along the top leg in order to allow the sliding of the sash along the top leg.

5. The sliding door as in claim 4 wherein said first channel curves toward the gasket proximate the first leg and the post on the sash rotates in order to allow the sash to follow the curve of the first channel.

6. The sliding door as in claim 4 wherein the bottom leg has a second channel and the sash has a pin that passes through the second channel, the pin stabilizing the sash during sash movement.

7. The sliding door as in claim 6 further comprising a weep hole located on the bottom leg such that fluid that enters the second channel is expelled through the weep hole.

8. The sliding door as in claim 4 wherein the top leg has a first ramped detent located proximate the first end of the first channel such that the roller rolls into the first ramped detent whenever the sash is being positioned into the closed position.

9. The sliding door as in claim 8 wherein the top leg has a second ramped detent located proximate the second end of the first channel such that the roller rolls into the second ramped detent whenever the sash is being positioned into the open position.

10. The sliding door as in claim 1 wherein the handle can be latched in order to maintain the dog in the acting relationship with the inner wall.

11. The sliding door as in claim 1 wherein the handle has a bi-directional clutch in order to maintain the dog in the acting relationship with the wall.

12. A sliding door comprising:

a frame having a top leg and a bottom leg joined by a first side leg and a second side leg such that a first channel is located along a first portion of the top leg, the first channel having a first end and a second end;

a pocket extending along a second portion of the top leg, the first side leg, a portion of the bottom leg, and between the top leg and the bottom leg, a compression gasket located within the pocket;

a first jamb extending along the first side leg, the first jamb having a first angled face that is angled relative to the first side leg, a first opening located in the first angled face, and a first inner wall;

a first sash, having a second jamb with a second angled face that is angled relative to the first side leg and is located along a first side edge of the sash, the first sash also having a top edge and a bottom edge joined by said first side edge and a second side edge, and an inner face and an outer face;

a post having a roller, the post attached to the top edge of the first sash and passing through the first channel such that the roller rests on the top leg in order to suspend the first sash therefrom and permit the sash to slide along the top leg;

a first dog rotatably attached to the first side edge of the first sash;

a handle attached to the first sash and operatively connected to the first dog for rotating the first dog;

a second sash attached to the frame; and wherein the first sash is slidable between an open position and a closed position wherein when the first sash is in the closed position, the first jamb seats on the second jamb such that the first angled face faces the second angled face, the handle is activated in order to rotate the first dog in order for the first dog to pass through the first opening and act on the first inner wall so that the inner face of the first sash presses against the gasket in order to achieve an airtight seal between the first sash and the gasket.

13. The sliding door as in claim 12 wherein first channel curves toward the gasket proximate the first end, and the post on the first sash rotates in order to allow the first sash to follow the curve of the first channel.

14. The sliding door as in claim 13 wherein the top leg has a first ramped detent located proximate the first end of the first channel such that the roller rolls into the first ramped detent whenever the sash is being positioned into the closed position.

15. The sliding door as in claim 14 wherein the top leg has a second ramped detent located proximate the second end of the first channel such that the roller rolls into the second ramped detent whenever the sash is being positioned into the open position.

16. The sliding door as in claim 12 wherein the bottom leg has a second channel and the first sash has a pin located on the bottom edge that passes through the second channel, the pin stabilizing the first sash during first sash movement.

17. The sliding door as in claim 16 further comprising a weep hole located on the bottom leg such that fluid that enters the second channel is expelled through the weep hole.

18. The sliding door as in claim 12 wherein the handle can be latched in order to maintain the dog in the acting relationship with the inner wall.

19. The sliding door as in claim 12 wherein the handle has a bi-directional clutch in order to maintain the dog in the acting relationship with the first inner wall.

20. The sliding door as in claim 12 further comprising a mullion that extends between the top leg and the bottom leg such that the portion of the pocket that extends between the top leg and the bottom leg is located on the mullion.

21. The sliding door as in claim 20 wherein the second sash is fixedly attached to the frame and to the mullion.

22. The sliding door as in claim 20 further comprising:

a third jamb extending along the second side edge the first sash, the third jamb having a third angled face; and a fourth jamb having a fourth angled face located along the mullion, a second opening located on the fourth angled face, and a second inner wall such that when the first jamb is in the closed position, the third jamb seats on the fourth jamb such that the third angled face faces the fourth angled face.

23. The sliding door as in claim 22 further comprising a second dog rotatably attached to the second side edge of the first sash and operatively connected to the handle such that when the handle is activated the second dog rotates in order for the second dog to pass through the second opening and act on the second inner wall.

* * * * *